United States Patent [19]
Jagnow
[11] 4,230,528
[45] Oct. 28, 1980

[54] METHOD FOR STARTING UP PLANT FOR PRODUCING FINE COKE

[75] Inventor: H. J. Jagnow, Dortmund, Fed. Rep. of Germany

[73] Assignee: Bergwerksverband GmbH, Essen, Fed. Rep. of Germany

[21] Appl. No.: 938,835

[22] Filed: Sep. 1, 1978

[30] Foreign Application Priority Data

Aug. 30, 1977 [DE] Fed. Rep. of Germany ..... 2739005

[51] Int. Cl.[2] ..... C10B 49/18; C10B 49/20; C10B 53/04

[52] U.S. Cl. ..... 201/12; 201/21; 201/22; 201/28; 201/36; 201/41; 201/43

[58] Field of Search ..... 201/43, 41, 36, 28, 201/21, 22, 12, 4

[56] References Cited

U.S. PATENT DOCUMENTS 2,955,988 10/1960 Sebastian ..... 201/43 X

FOREIGN PATENT DOCUMENTS 1240037 5/1967 Fed. Rep. of Germany ..... 201/12
2208148 8/1973 Fed. Rep. of Germany ..... 201/28
2302332 9/1976 France ..... 201/12

*Primary Examiner*—Barry S. Richman
*Attorney, Agent, or Firm*—Michael J. Striker

[57] ABSTRACT

Prior to starting up a plant in which fine coke is produced by mixing high bituminous lignite coal with circulating hot fine coke serving as a heat carrier in the plant, hot inert gas is admitted into the mixing unit in which the coal and coke are admixed. Only after all parts of the plant are thus preheated, the operation of the plant is started up.

2 Claims, 1 Drawing Figure

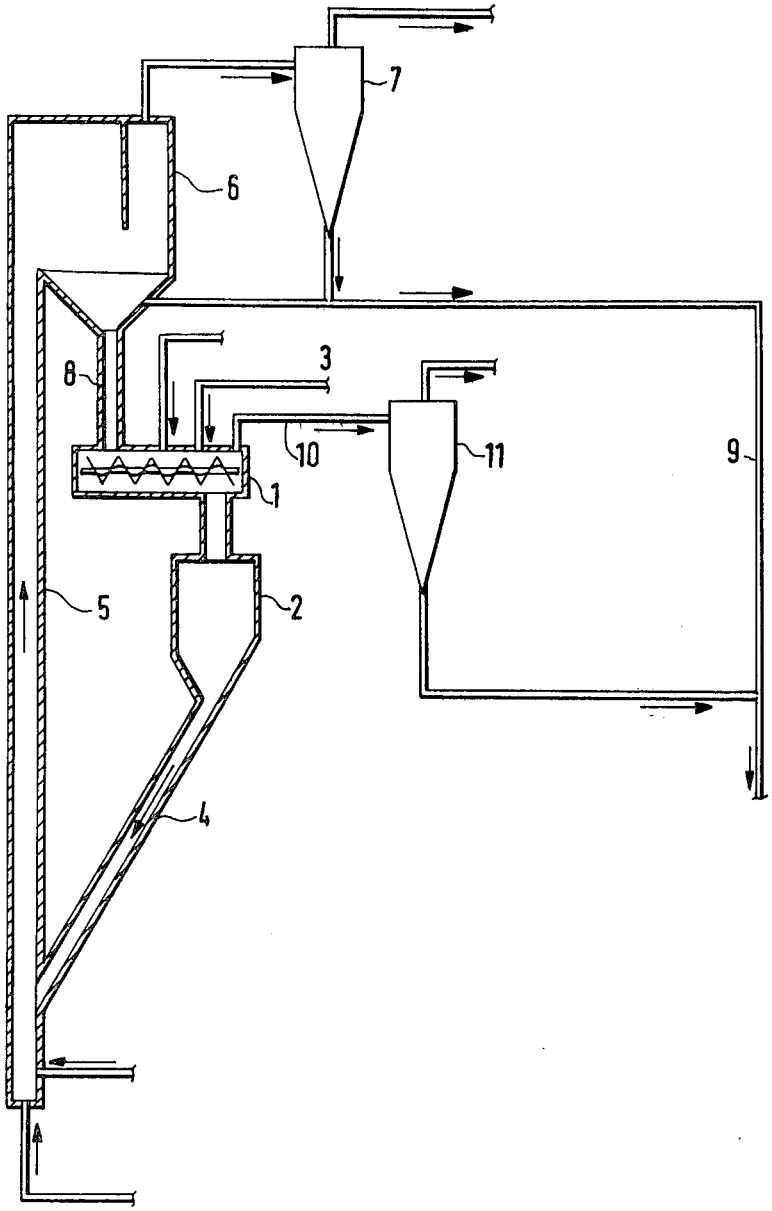
7
6
8
3
10
11
9
1
5
2
4

METHOD FOR STARTING UP PLANT FOR PRODUCING FINE COKE

The invention relates to a method for starting up plants for producing fine coke by mixing high bituminous lignite coal with hot fine coke in a mixing unit, and liberating gas from the high bituminous lignite coal with the hot fine coke which is concurrently passed through the circuit and serves as heat carrier.

Fine coke is needed for the producing of form coke, in which hot fine coke is mixed with binder coal at a temperature of about 450° C. and is hot pressed into the form of briquettes. This hot fine coke is produced by low-temperature carbonization of fine coal in a continuous heat carrier circuit method, in which the fine coke produced serves, in a grain size of up to 6 mm, as heat carrier. Dry fine coal is mixed, in a mechanically driven double lens mixing unit, with the hot fine coke. By reason of the rapid heating of the coal spontaneous liberation of gas starts in the mixing unit; condensible products are mainly released. However, the main liberation of gas occurs in a downstream-arranged gas liberation unit, in which the coke is held for a few minutes. Heat-carrying coke passed through the circuit, and newly formed coke are then fed, by way of an lock section, to a flight stream tube in which, during the pneumatic conveyance with hot combustion gases, the fine coke is heated to temperatures up to about 780° C. The hot fine coke is separated from the stream of combustion gas in a collecting hopper. The coke component serving as heat carrier passes, by way of an lock section, back into the mixing unit, while the remainder of the coke is fed to the briquetting unit. The temperature difference between the inlet and outlet for the material in the mixing unit amounts, dependent upon the particular quantity in each case of the heat-carrying coke fed in the circuit, is 30° to 100° C.

Together with the carbonization gases the tar which is obtained and in vapor form, is separated from the gas in a downstream-positioned condensation device. As the gases and vapour from the mixing unit, together with the gases from the gas liberating unit, also deliver fine coke dust, a cyclone is connected, in front of the condensation device, into the carbonization gas duct. The ducting system to and from the cyclone, and also the cyclone itself, are provided with a refractory brick lining.

If the dust is not separated from the carbonization gases it will be found in the condensed tar which, if the yield of dust is large, may become so viscous that it can no longer be pumped.

When the gas liberation unit is starting up the refractory brickwork is usually cold, so that condensation phenomena of the tar occur in the cyclone; the precipitated tar may, together with the dust, lead to the unit becoming clogged. In particular, the extraction of dust from the cyclone is seriously hindered by the tar condensation.

However, it was not found satisfactory to preheat the parts of the plant endangered by condensation with a gas burner or with electric heating means. Underlying this invention is therefore the object of providing a remedy for this and of enabling the cold plant to be started up smoothly and reliably for the production of fine coke.

According to the invention this object is realized by, when the fine coke circulation, serving as heat carrier is started up, feeding inert gas to the mixing unit prior to the infeed of the high bituminous lignite coal.

Thus, it has been found that an increased quantity of hot, extremely fine coke dust has been entrained by the infeed of inert gas; due to the absence of condensible tar vapour this coke dust has not led to agglomeration and, serving as heat carrier, has resulted in adequate heating of the cold parts of the plant. In particular, in this way the outlet of the cyclone and the downstream-positioned dust discharge devices are heated in a short time. When the plant is being started up the quantity of inert gas introduced should at the most correspond to the quantity of gas subsequently liberated.

It is appropriate, when carrying out the method according to the invention, to operate the heat-carrying coke circuits, when the plant is being started up with the introduction of the inert gas, without the infeed of high bituminous lignite coal for about 1 to 2 hours, the coke guided in the circuit being heated, by the hot combustion gases which effect the pneumatic conveyance, to about 750° C. The infeed of high bituminous lignite coal should only then be commenced; the infeed starts with a small quantity of coal and is slowly increased to the gas-liberating quantity, while at the same time the temperature in the coke circuit is gradually lowered from about 750° C. to about 650° to 700° C.

An embodiment of the invention is illustrated in the drawing, and is described in detail below. The single FIGURE is in the form of a block diagram of a plant for the low-temperature carbonization of fine coal, with a stream of hot fine coke serving as heat carrier. High bituminous lignite coal is mixed with hot circuit coke in a mixing unit 1; spontaneous liberation of gas starts during the operation. The liberation of gas is concluded in a downstream-positioned gas liberation unit 2. While the plant is being started up inert gas is led into the mixing unit 1 through a duct 3. The hot fine coke is led, by way of an lock section 4, into a conveyance tube 5, in which this hot coke is pneumatically conveyed, with hot combustion gases, into a collecting hopper 6. During conveyance the fine coke is heated to about 700° C. The combustion gases are passed, by way of a cyclone 7 in which fine coke is separated out, to an after-combustion unit. The coke component serving as heat carrier passes from the collecting hopper 6 to an excluder lock section 8 and thence back into the mixer 1, while the remainder of the coke is fed, by way of a duct 9, to the briquetting unit. While the plant is being started up heated inert gas and fine hot coke dust, entrained with this inert gas, passes from the hot fine coke in the mixing unit 1, through a duct 10, into a cyclone 11, in which the coke dust is separated. The introduction of the high bituminous lignite coal is only commenced when all parts of the plant have been heated by means of the hot inert gas and dust.

I claim:

1. In a process for producing fine coke in a plant system including a mixing unit, by mixing high bituminous lignite coal with hot fine coke in said mixing unit and degassing the high bituminous coal, said hot fine coke serving as a heat carrier and being circulated through said system, the improvement comprising introducing inert gas into the mixing unit along with the hot fine coke prior to the introduction of the high bituminous lignite coal, and circulating said inert gas and said hot fine coke through said system, whereby a cold parts of said system are heated up so as to minimize condensation of tar generated in the production of said fine coke in said system.

2. Method according to claim 1, in which the quantity of inert gas introduced corresponds at the most to the quantity of gas subsequently liberated.

* * * * *

UNITED STATES PATENT AND TRADEMARK OFFICE

CERTIFICATE OF CORRECTION

PATENT NO. : 4,230,528

DATED : October 28, 1980

INVENTOR(S) : Hans-Joachim Jagnow

It is certified that error appears in the above-identified patent and that said Letters Patent are hereby corrected as shown below:

In the heading, the names and addresses of the assignees should read -- Bergwerksverband GmbH, Essen, Federal Republic of Germany and Ruhrkohle AG, Essen, Federal Republic of Germany --.

Signed and Sealed this

*Third* Day of *March 1981*

[SEAL]

*Attest:*

RENE D. TEGTMEYER

*Attesting Officer*

*Acting Commissioner of Patents and Trademarks*